United States Patent [19]

Heien

[11] Patent Number: 4,756,582

[45] Date of Patent: Jul. 12, 1988

[54] UPRIGHT DISH DRAINING DEVICE

[76] Inventor: Troy A. Heien, 5704 Southview Rd., Laramie, Wyo. 82070

[21] Appl. No.: 937,484

[22] Filed: Dec. 3, 1986

[51] Int. Cl.[4] ..... A47B 77/06

[52] U.S. Cl. ..... 312/229; 211/41

[58] Field of Search ..... 211/41; 312/229

[56] References Cited

U.S. PATENT DOCUMENTS

| | | | |
|---|---|---|---|
| 542,912 | 7/1895 | Wood | 211/41 |
| 1,001,520 | 8/1911 | Greason | 312/229 X |
| 1,037,073 | 8/1917 | Sonnemann | 312/229 X |
| 1,518,216 | 12/1924 | Onody | 211/41 |
| 1,528,744 | 3/1925 | Dix | 211/41 |
| 1,789,232 | 1/1931 | Hertz | 211/41 |
| 1,842,118 | 1/1932 | Resnik et al. | 211/41 |
| 1,986,486 | 1/1935 | Swanson | 211/41 |
| 2,070,826 | 2/1937 | Dick | 211/41 |
| 2,538,223 | 1/1951 | Brandstrom | 312/229 X |
| 2,635,027 | 4/1953 | Rasmussen | 312/229 |
| 2,852,030 | 9/1958 | Nord | 211/41 X |
| 3,258,127 | 6/1966 | Cushing | 211/41 |

*Primary Examiner*—Joseph Falk

*Attorney, Agent, or Firm*—Fleit, Jacobson, Cohn & Price

[57] ABSTRACT

A vertically disposed article support for dishes, glasses, cups and other eating utensils is provided and includes vertically spaced article support portions from which articles to be gravity drained of rinse water and to be air dried may be supported. The lower portion of the article support defines an upwardly opening catch basin or trough for receiving rinse water drained from articles supported from the support and the catch basin includes a gravity drain outlet equipped with a flexible drain tube whereby the article support may be positioned adjacent a kitchen sink and drain water collected thereby directly into the sink, the article support occupying a relatively small counter plan area adjacent the sink.

3 Claims, 2 Drawing Sheets

UPRIGHT DISH DRAINING DEVICE

BACKGROUND OF THE INVENTION

1. Field of the Invention

This invention relates to an upright dish and eating utensil support constructed in a manner for supporting dishes and other eating utensils in position for gravity draining rinse water therefrom and for air drying purposes. The support includes a lower upwardly opening rinse water catch basic for collecting water gravity draining from dishes and other utensils supported from the invention and the catch basin is provided with a drain fitting having a flexible drain hose operatively connected thereto, the discharge end of the drain hose being adapted to extend down into a drain equipped kitchen sink. The upright support is designed to be wall mounted closely adjacent the kitchen sink, or supported directly from the rear margin of a counter surface in which a kitchen sink is recessed.

2. Description of Related Art

Various different forms of dish draining devices heretofore have been provided such as those disclosed in U.S. Pat. Nos. 542,912, 1,518,216, 1,528,744, 1,842,118, 1,986,486, 2,070,826 and 3,258,127. However, these previously known forms of dish supports do not include the overall combination of structural features which particularly well adapt the instant invention for use in upstanding position supported from or closely adjacent a kitchen wall surface extending upwardly above an attendant counter surface and in a manner with the dish support occupying minimum counter space adjacent an attendant kitchen sink.

SUMMARY OF THE INVENTION

The dish draining device of the instant invention includes an upstanding support panel from which a formed wire structure or frame is mounted and the wire structure is of a configuration to support various dishes, glasses, cups and saucers, etc. therefrom. In addition, a receptacle is provided for receiving eating utensils and the device is disposed in upstanding position for mounting from a wall surface at the rear of a kitchen counter adjacent a kitchen sink. The lower portion of the device includes a drainage water catch basin and the basin includes a drain fitting with which the inlet end of a flexible drain hose is operatively connected, the outlet end of the drain hose being receivable within an adjacent drain equipped kitchen sink.

As an alternate method of supporting the draining device in upstanding position, the lower end of the device may include foot portions sufficient to support and maintain the device in upstanding position at the rear margin of a counter area independent of actual attachment of the device to a wall surface.

The main object of this invention is to provide a dish draining device which may be used for draining washed and rinsed dishes as well as kitchen utensils and which may occupy only a small plan area over a rear marginal portion of a kitchen counter adjacent a kitchen sink and which will therefore leave unoccupied the remaining counter area forward of the dish draining device and normally also occupied by the conventional horizontally disposed dish draining device extensively heretofore used.

Another object of this invention is to provide a dish draining device including support structure thereof whereby a plurality of relatively large diameter dishes may be supported therefrom for draining and with the supported dishes occupying only a small plan area.

Still another object of this invention is to provide an upright dish draining device which may be either counter top supported or wall mounted.

Still another object of this invention is to provide an upright dish draining device which will greatly facilitate manual washing of dishes and other eating utensils and the gravity drainage of rinse water therefrom preparatory to air drying.

A final object of this invention to be specifically enumerated herein is to provide an upright dish draining device in accordance with the preceding objects and which will conform to conventional forms of manufacture, be of simple construction and easy to use so as to provide a device that will be economically feasible, long lasting and relatively troublefree in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
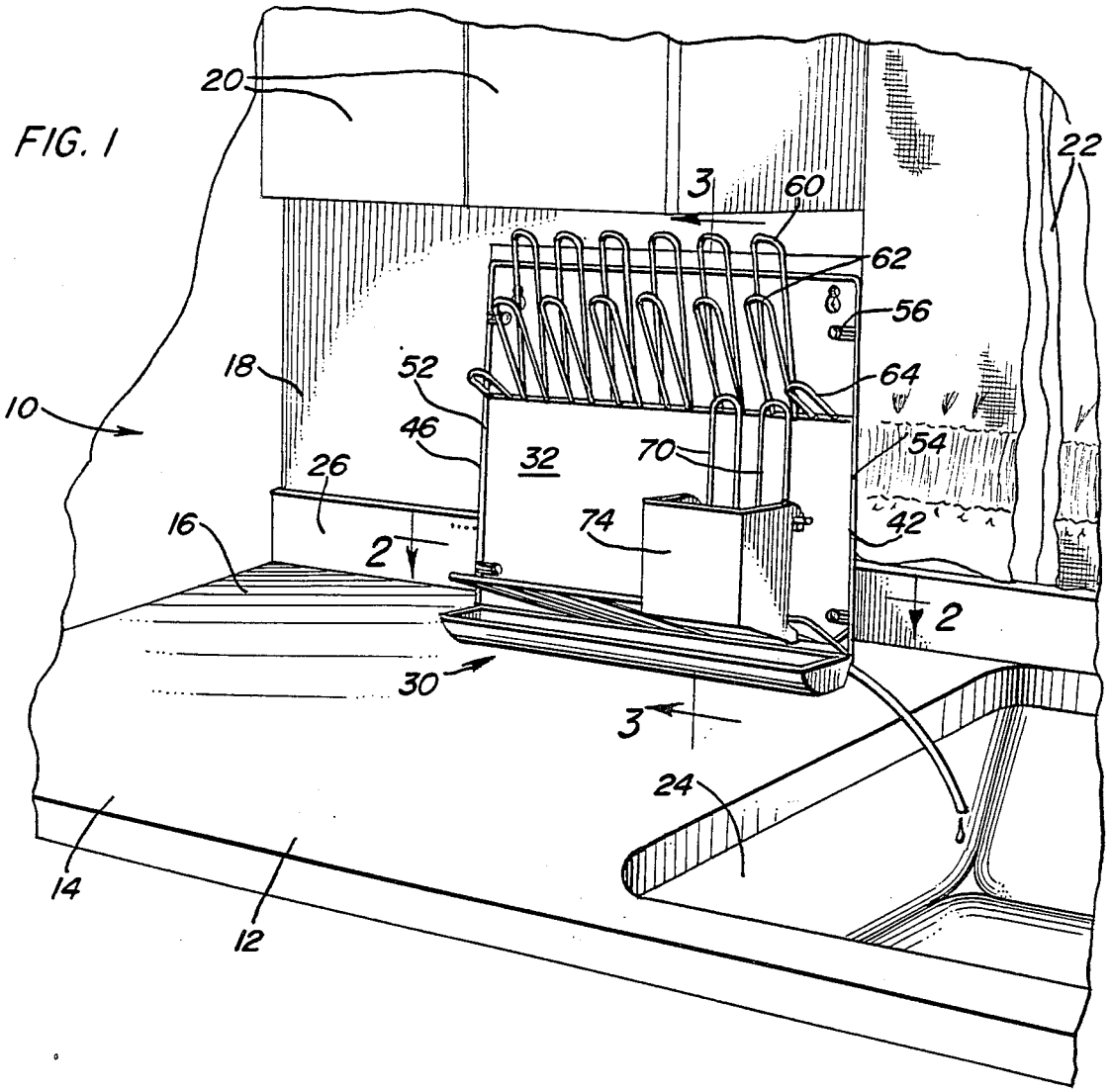
FIG. 1 is a perspective view of the dish draining device mounted in upstanding position from a kitchen wall surface extending upward from the rear marginal portion of a kitchen counter area closely adjacent a kitchen sink.

Referring now more specifically to the drawings the numeral 10 generally designates a domestic kitchen area including a kitchen counter 12 having front and rear margins 14 and 16. The area 10 includes a wall 18 which extends upwardly from the rear margin 16 of the counter 12 and overhead kitchen cabinets 20 are mounted from the wall 18 and extend outwardly therefrom over the rear margin 16 of the kitchen counter 12 in vertically spaced relation relative to the counter 12. The wall 18 includes a window opening 22 therein over a drain equipped kitchen sink 24 recessed within the counter 12 and the rear margin 16 of the counter 12 includes an upstanding trim strip 26 extending along the wall 18 above the counter 12.

Conventionally, dishes to be hand washed may be rinsed and then washed within the sink 24 and thereafter placed in a horizontally elongated dish draining device (not shown) of conventional design occupying a major portion of the plan area of the kitchen counter 12 disposed to the left of the sink 24 as viewed in FIG. 1. However, utilization of this large area of the counter space by a horizontally disposed dish drainer can be objectionable in many instances.

The dish draining device of the instant invention is referred to in general by the reference numeral 30 and is disposed in upstanding position. The device 30 includes a mounting panel 32 having keyhole shaped openings 34 formed therethrough to be used, in conjunction with fasteners 36, for securing the panel 32 to the wall 18 with the lower marginal edge 33 of the panel 32 terminating downwardly a spaced distance above the trim strip 26 or extending downwardly over the front surface of the trim strip 26 and terminating closely above the counter 12.

The panel 32 includes an integral lower drip catch basin or channel 40 extending fully across the lower marginal edge of the panel 32 and projecting outwardly from the front side 41 thereof and a formed wire frame 42 is provided and supported from the panel 32 through the utilization of suitable fasteners 44. The frame 42 includes a rectangular peripheral component 46 including upper and lower horizontal bars 48 and 50 and vertical opposite side bars 52 and 54 and the fasteners 44 are secured through fastener abutments 56 carried by and projecting inwardly from the upper and lower end portions of the bars 52 and 54.

An intermediate height bar 58 extends between the vertical bars 52 and 54 a spaced distance below the upper fastener abutments 56 and supports horizontal rows of long and short variously inclined inverted U-shaped members 60 and 62, respectively therefrom over which inverted glasses may be placed for gravity water drainage therefrom. In addition, further more inclined U-shaped members 64 are supported from the opposite ends of the bar 58 and an inclined U-shaped frame 66 is supported from the lower ends of the vertical bars 52 and 54 and inclined, diagonal bars 66 extend and are secured between the bar 50 and the bight position 68 of the U-shaped frame 66.

Figure 2:
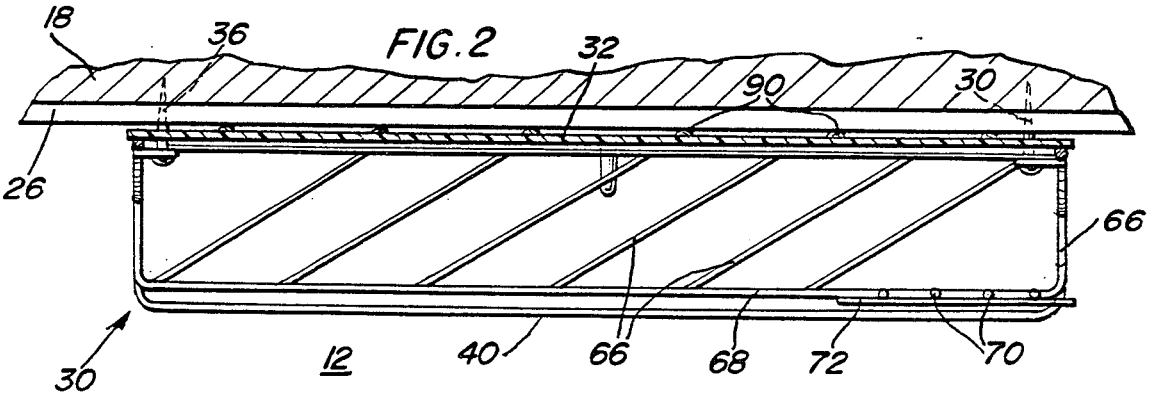
FIG. 2 is an enlarged horizontal sectional view taken substantially upon the plane indicated by the section line 2—2 of FIG. 1.
Figure 3:
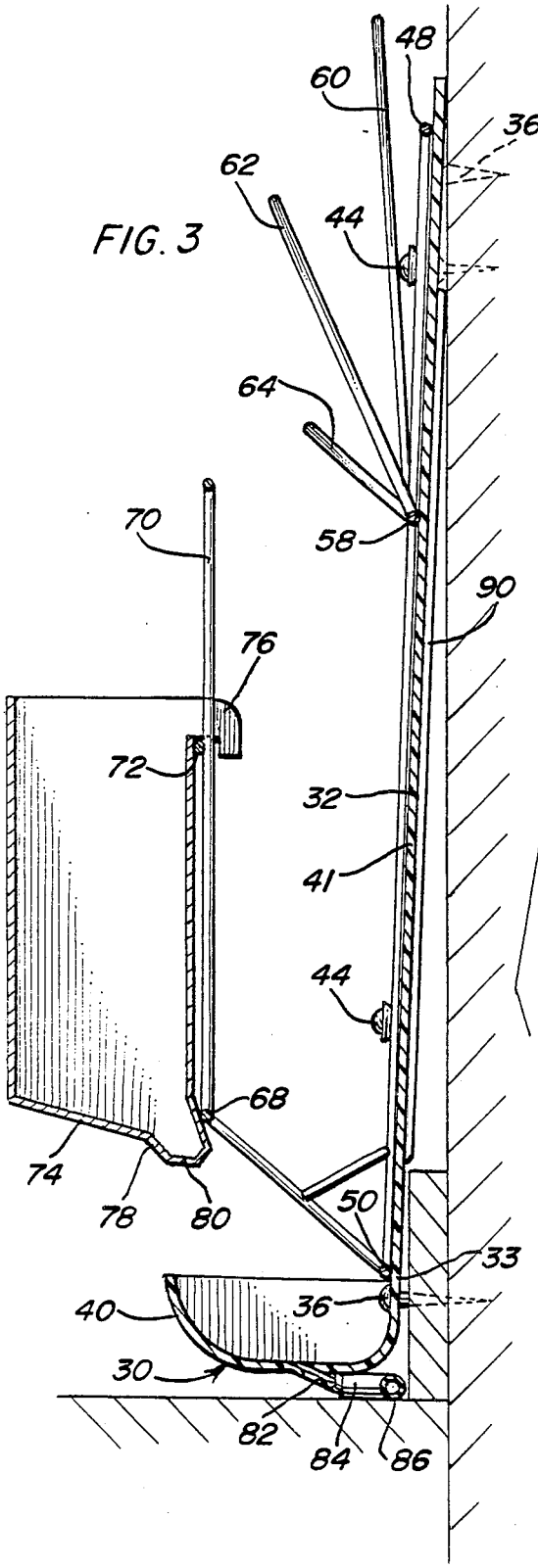
FIG. 3 is an enlarged vertical sectional view taken substantially upon the plane indicated by the section line 3—3 of FIG. 1.
Figure 4:
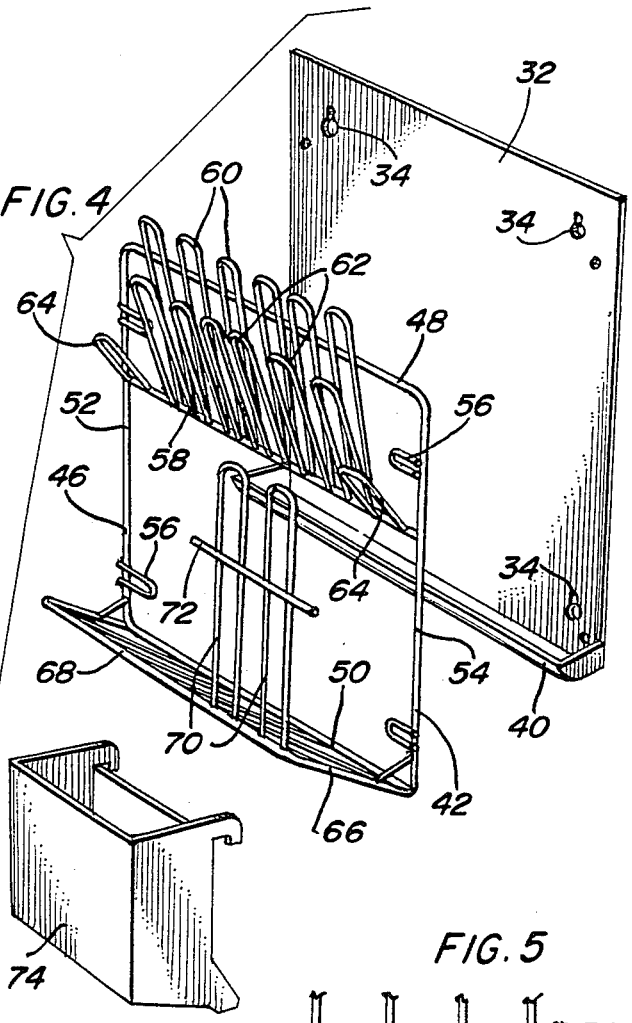
FIG. 4 is an exploded perspective view of the dish draining device.
Figure 5:
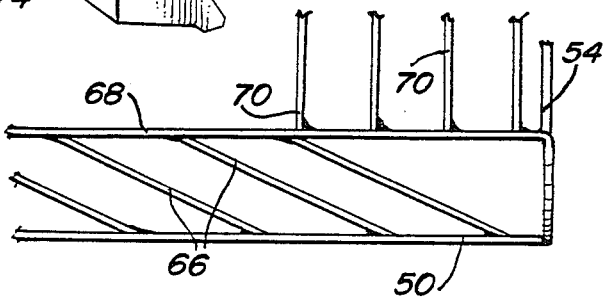
FIG. 5 is a fragmentary enlarged front elevational view of the forward right hand corner portion of the wire rack component of the dish draining device.

The right end of the bight portion 68 as viewed in FIGS. 2, 4 and 5 includes a pair of inverted vertical U-shaped members 70 supported therefrom and interconnected by an upper horizontal bar 72 extending therebetween. A silverware holder 74 is provided and defines an upwardly opening receptacle provided with rearwardly directed downwardly opening hook portions 76 engageable over opposite ends of the bar 72 for support of the holder 74 from the U-shaped members 70 on the front sides thereof. The holder 74 includes a water drainage sump 78 including an outlet opening 80 disposed over the catch basin or channel 40 for drainage of water from the holder 74 into the catch basin or channel 40.

The lower portion of the catch basin or channel 40 includes a gravity drain outlet fitting 82 and the inlet end 84 of a flexible drain hose 86 is operatively coupled to the fitting 82 while the outlet end of the hose 86 extends over the counter 12 and curves downward into the kitchen sink 24 for direct discharge of water therefrom into the sink 24.

The portions of the U-shaped members 70 projecting above the bar 72 may be used to support inverted drinking cups, the spaces between the diagonal bars 66 may be used to receive different sized plates, the U-shaped members 60 and 62 may have inverted glasses disposed thereover, the U-shaped member 64 may have the handle portions of large head equipped utensils inserted downward thereinto and various pieces of silverware may be removably supported from the holder 74. In this manner, dishes and kitchen utensils which have been washed and rinsed may be supported from the device 30 for gravity drainage of rinse water therefrom and for air drying.

The rear of the panel 32 includes vertically extending ribs 90 for insuring air circulation between the rear surface of the panel 32 and the wall 18. Further, the panel 32 may be mounted from the wall 18 at an elevation wherein the catch basin or channel 40 is spaced above the trim strip 26. In addition, the opposite side portions of the device 30 may be provided with depending feet whereby the device 10 may be supported solely from the counter 12 by such feet independent of any semipermanent or permanent attachment to the wall 18.

The device 30 occupies only a small plan area thereby freeing substantially all of the counter space adjacent the sink 24 for other purposes. Also, the panel 32 and catch basin or channel 40 may be constructed of plastic and the holder 74 also may be constructed of plastic. Further, the frame 42 may be constructed of non-corrosive wire and be rubber or plastic coated.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. In combination with a kitchen counter portion projecting outward from an upstanding wall portion and wherein said counter portion includes a drain equipped sink recessed therein, an upstanding dish draining device including portions thereon for support of articles including plates, glasses and silverware therefrom in attitudes promoting gravity drainage of rinse water from and air drying of said articles, said dish draining device including an upstanding panel having front and rear sides and a lower marginal portion, said lower marginal portion including an elongated upwardly opening catch basin extending longitudinally thereof and projecting outwardly of said front side for catching rinse water gravity draining from said articles, said catch basin including a horizontal length appreciably greater than its horizontal width measured at right angles relative to said horizontal length, said catch basin including a gravity drain outlet, a flexible drain tube having an inlet end operably coupled to said outlet and an outlet end positioned for direct discharge of water therefrom into said sink, said panel including support means for support thereof in upstanding position adjacent and generally paralleling said wall portion above said counter portion closely adjacent a side marginal portion of said sink, a wire frame mounted on the front side of said panel above said catch basin and including upper, intermediate height and lower horizontal bars extending between and supported from vertical opposite side bars, a pair of rows of inverted long and short U-shaped members opening toward and supported from said intermediate bar and spaced therealong, said long U-shaped members being slightly upwardly and outwardly inclined from the front side of said panel and said short U-shaped members being more greatly upwardly and outwardly inclined relative to said front side of said panel, said U-shaped members being adapted to receive inverted drinking containers thereover, a lower U-shaped member opening toward and supported from the lower ends of said opposite side bars and projecting outwardly from the front side of said panel said lower U-shaped member being upwardly and outwardly inclined relative to the horizontal, said lower U-shaped member including an outer bight portion generally paralleling said lower bar, a plurality of substantially equally transversely spaced apart inclined diagonal bars extending between and supported from said bight portion and said lower bar, the spacing between said diagonal bars being adapted to receive edge upstanding plate-like articles therebetween with peripherally spaced portions of said plate-like articles engaged with and supported from said bight portion and lower bar, said long, short and lower U-shaped members being disposed within a vertically extending area received within the confines of said catch basin.

2. The counter portion, wall portion and sink and dish draining device combination of claim 1 wherein said counter is horizontally elongated and said wall portion is spaced longitudinally of said counter from said sink, said dish draining device being disposed with said horizontal length extending along and closely paralleling said wall portion.

3. The combination of claim 1 wherein one end of said bight portion includes an upstanding support portion from which an upwardly opening utensil receptacle is removably supported.

* * * * *